United States Patent [19]

Ladyjensky

[11] Patent Number: 5,029,049

[45] Date of Patent: Jul. 2, 1991

[54] TUBULAR CHEMILUMINESCENT LIGHTING ELEMENT

[75] Inventor: Jacques Ladyjensky, Brussels, Belgium

[73] Assignee: American Cyanamid Company

[21] Appl. No.: 603,347

[22] Filed: Oct. 26, 1990

[30] Foreign Application Priority Data

Mar. 3, 1990 [BE] Belgium ..... 090-00271

[51] Int. Cl.[5] ..... F21K 2/00

[52] U.S. Cl. ..... 362/34; 206/222

[58] Field of Search ..... 362/34, 84; 206/222; 313/483

[56] References Cited

U.S. PATENT DOCUMENTS

| | | | |
|---|---|---|---|
| 3,578,962 | 5/1971 | Gerber | 362/34 |
| 3,813,534 | 5/1974 | Gilliam | 362/34 |
| 4,064,428 | 12/1977 | Van Zandt | 362/34 |
| 4,379,320 | 4/1983 | Mohan et al. | 362/34 |

*Primary Examiner*—Stephen F. Husar
*Attorney, Agent, or Firm*—Frank M. Van Riet

[57] ABSTRACT

The invention reveals a chemiluminescent lighting element which consists of two concentric, long tubes each of which is made of a translucent and preferably flexible, synthetic material, one of which contains a first chemical liquid which emits chemiluminescent light, and the other of which contains a second chemical liquid whose function is to cause the light activation of the first liquid. The internal tube is provided with an element which moves essentially along the entire length of said tube, by a pressure imparted to it through the wall of the external tube. The sliding element is provided with a blade, which cuts the internal tube longitudinally as the element progresses along the tube and thus causes the liquid in each tube to mix whereby the first liquid is activated and chemiluminescent light is produced.

10 Claims, 2 Drawing Sheets

TUBULAR CHEMILUMINESCENT LIGHTING ELEMENT

BACKGROUND OF THE INVENTION

The principles and techniques for the production of chemiluminescent light are well known as described, for example, in U.S. Pat. No. 4,678,608.

For several years, devices composed of translucent pipes or tubes have been in existence which are filled with a liquid which can generate chemiluminescent light. The devices are particularly useful and appreciated for signaling, as night beacons, advertising, decoration, or for entertainment. The devices which are currently known can be grouped in two principal categories, each one of which presents serious drawbacks which are alleviated by the devices of the present invention.

Devices of the first category, and the chemicals useful therein are described for example in U.S. Pat. Nos. 3,597,362 and 3,576,987. They contain, in addition to the principal chemiluminescent liquid, a glass tube which is filled with an activating liquid. This glass tube breaks when the user, at the wanted time, bends the device, thus causing the mixture of the two liquids and the emission of light. A serious drawback of this type of device consists of the necessary restriction in the length of the glass tube, generally at most one-half meter, because a long glass tube could easily be broken prematurely, either by the user himself, or during handling, transport, packaging and, even during manufacturing. In addition, the glass material, in some instances, is not chemically inert with respect to the liquids used in the device and therefore, over long periods of time, changes in the chemicals occur during storage. There also may be a certain aversion to the breaking of the glass because some users may be afraid that shards of glass could possibly perforate the wall and thereby cause injury to the user.

The second category of devices is characterized by the use of a chemiluminescent liquid which is activated in advance with the corresponding activator then placed in the device in question. Thereafter, the device is quickly placed in a freezing environment whereupon the low temperature stops the chemiluminescent emission reaction. When the user decides to use the light, he removes it from the cold and light emission resumes upon warming. The drawback in this case, as can readily be seen, consists in the need to maintain the device in a freezing environment which generally involves the use of portable refrigerators filled with liquid nitrogen, during the entire sequence of storage, transportation, and sale to the final user. These constraints are expensive and the use of this device is, in addition, less satisfactory from the standpoint of light emission than the first device, described above.

Other devices have also been described which combine the two liquids, in separate compartments of the container, in which the separation is achieved by a various means such as rupturable seals which permits their mixture at the time of use. In this regard, reference is made to U.S. Pat. Nos. 3,749,620; 3,539,794; 4,061,910; 3,149,943 and French Patent No. 87 11296.4. Devices having two compartments, each having a tubular shape are shown. They can be aligned along the same axis, the total length of such an assembly however, necessarily remaining very small in comparison to the diameter since mixing is made very difficult, if not impossible, because of the distance between the liquids. To prepare a very long tube one could clearly design a device with an alternation of tubular compartments, all along the same axis, as extensions of each other, which would contain alternately the chemiluminescent liquid and the activator with interposition of the separating devices which the user would then have to activate all at the desired moment. The placement of such a succession of antagonistic liquids would result in a high manufacturing cost and its use would be extremely difficult.

SUMMARY OF THE INVENTION

The present invention permits the preparation of luminous tubes with unlimited length i.e. several meters and even several tens of meters, and in a more economical manner than with the use of a glass capillary, with the savings being increasingly large as the length increases.

To correct the above-described drawbacks of the prior devices, the present invention employs the use of two concentric tubes, with great length in comparison to the diameter, made of a translucent, and preferably flexible, synthetic material which is chemically inert with respect to the chemiluminescent liquids, for example, polyethylene. One of the tubes, for example, the external tube, is filled with the chemiluminescent liquid itself, while the other tube, in this case the internal tube, contains the liquid whose function it is to activate the chemiluminescent liquid.

At one location along its length, the internal tube is surrounded with a sliding element whose length is very short in comparison to that of the inner tube itself. This sliding element, is preferably positioned at one of the extremities of the inner tube, although it may be positioned anywhere and can be of any shape, for example, a sleeve which can slide along the length of the inner tube. The element can be moved along the length of the inner tube by pushing it, for example manually, by the application of pressure through the wall of the external, flexible tube.

This sliding element contains a flat blade whose plane parallels the longitudinal axis of the internal and external tubes. The blade passes through the wall of the internal tube, preferably through its entire diameter. The cutting edge of the blade is directed in the direction of the path to be traversed As the sliding element is moved, the blade cuts the internal tube, which results in the release of the contained liquid and a continuous and homogeneous mixing of the two liquids over the entire length of the two concentric tubes.

The two tubes preferably have a circular cross section although any cross-sectional shape is permitted. Consequently, the sliding element also preferably has a circular cross section, advantageously, with an inside diameter which is slightly larger than the outside diameter of the internal tube, so that it is guided by the latter during its travel path, and thus keeps the blade in the appropriate position. The general shape of the sliding element is that of a short cylinder or sleeve. Preferably, the extremity of this cylinder, behind the direction of movement, does not have any sharp edges. This extremity is the one against which the pressure is applied by the user. Consequently, one uses a relatively blunt edge to achieve this sliding motion of the sliding element, squeezing the walls of the external tube slightly beyond one end of the cylinder, as if one wanted to crush the walls, so as to push the sliding element in the direction of the other inner tube extremity, i.e. the movement is peristaltic in nature.

Alternatively, the user may employ a tool which consists of two parallel hard rollers with a distance between them which is slightly smaller than the outside diameter of the external tube so as to cause a slight crushing of the latter. The rollers are mounted on two axles which are joined by a cross-brace which the user holds during the use. The mixture of the liquids in the device is achieved by the relative displacement of this device with respect to the tube.

The sliding element may be made of any rigid material, e.g. metal or a synthetic material, which is compatible with the chemiluminescent liquid, such as, for example, polypropylene. The blade may be made of any inert metal such as thin steel, of the razor blade type, and is combined with the material of the sliding element by supermolding the latter around the extremities of the blade. The entire assembly is small and cannot be dismantled, thereby preventing any accidental contact with the blade during use or in case the user is too adventurous or curious.

In a preferred embodiment, the blade already passes through the internal tube at its starting position, at one of the extremities of the tube, so that the user does not need to perform any other maneuver except a simple longitudinal push from one extremity to the other extremity. In this instance, to avoid a premature mixing of the two liquids, the blade, in this initial position, passes through the extremity of the internal tube at a place where the latter contains no liquid, i.e. in a portion of the tube where the walls are united, such as by soldering with heat.

There is no limitation to the length of the device described above. The longer the length, the more economical the device since only a single sliding element is ever required for the activation step, regardless of the length of the tube.

DESCRIPTION OF THE INVENTION INCLUDING PREFERRED EMBODIMENTS

To clarify the invention, one embodiment is described below as an example with reference to the appended drawings of which:

Figure 1:
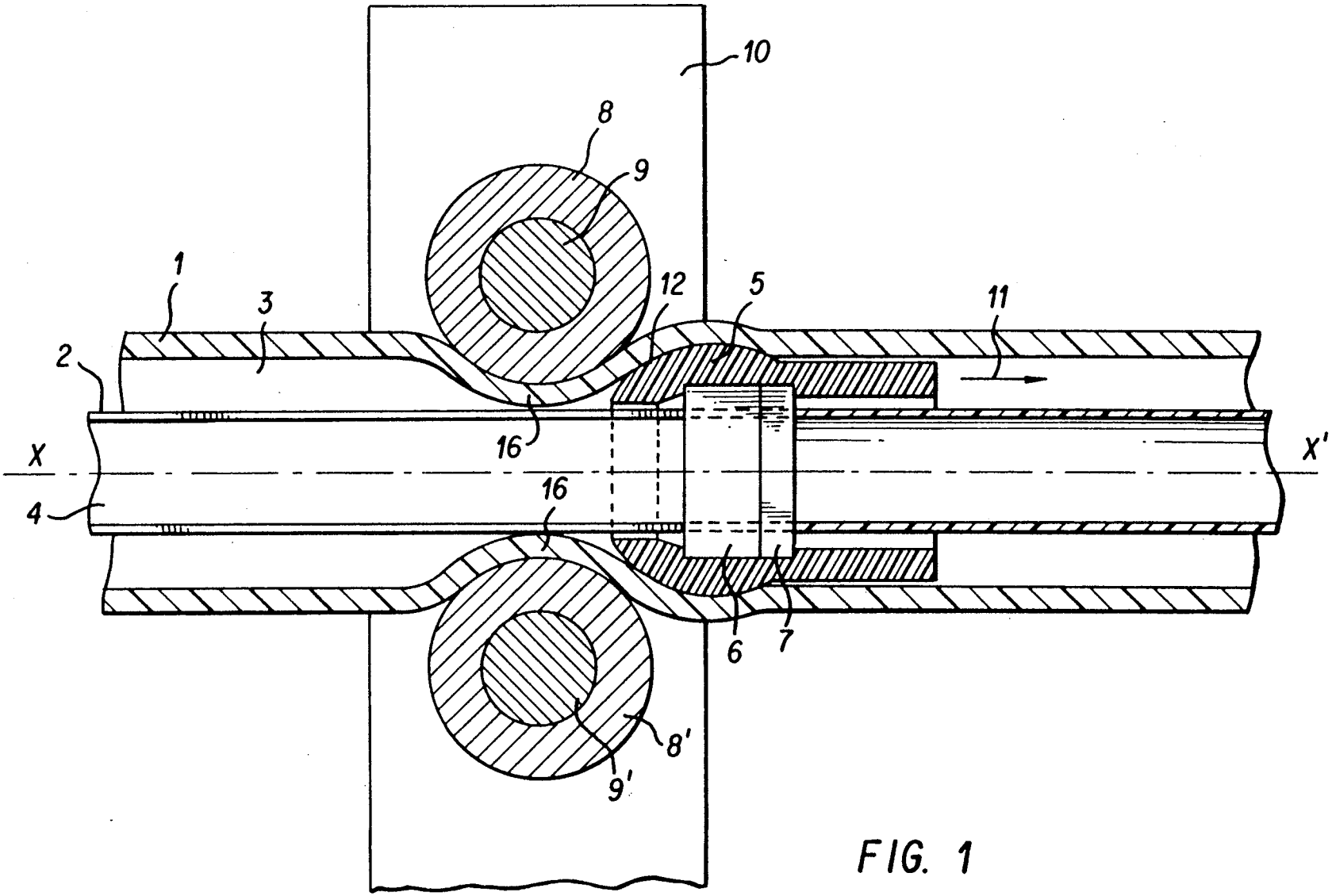
FIG. 1 represents, a longitudinal cross section of a section of the device according to the invention, which also contains an optional tool which facilitates the mixing step.

Referring to FIG. 1, the external tube made of flexible, translucent synthetic material is represented by (1); this tube contains chemical liquid (3) whose function is to emit chemiluminescent light. Internal tube (2), which is concentric with respect to the external tube (1), contains liquid (4), whose function is to activate liquid (3) when mixed with therewith. Either or both of these liquids can be modified to contain a lubricant so as to facilitate the movement of element (5) along inner tube (2). Dibutyl phthalate, which also may be a solvent for the active ingredients of the liquids is exemplary of a lubricating material.

Sliding element (5) is a cylinder which is adapted to be moved in the direction indicated by arrow (11). Element (5) is approximately cylindrical in shape, its inside diameter is slightly larger than the outside diameter of tube (2), and its outside diameter is slightly smaller than the inside diameter of tube (1); thereby permitting easy passage of liquid (3) by element (5) during its displacement and appropriate guiding of the sliding element. This guiding function can be further improved by providing longitudinal grooves or edges in the inside of the element (5) so as to restrict or eliminate the clearance between of the internal tube and the sliding element.

In the direction opposite to the direction of movement, element (5) is provided with a blunt edge (12), the function of which is to facilitate the peristaltic pushing motion during activation. Edge (12) is shown such that the cylindrical shape of element (5) has been bulged so that the overall shape of element (5) is of a section of a sphere which is attached to a cylinder with slightly smaller diameter.

Blade (6) has the shape of a very thin component whose plane contains the XX' axis of the tubes (1) and (2). At its extremities, the blade is embedded (by supermolding) in the wall of element (5), as shown more clearly in FIG. 3. Although blade (6) is shown embedded at both its extremities in the wall of element (5), it is also permissible to embed the blade in the tube wall at one of its extremeities, whereby the blade will cut only one slit in the wall of tube (2) rather than two as is depicted.

Figure 2:
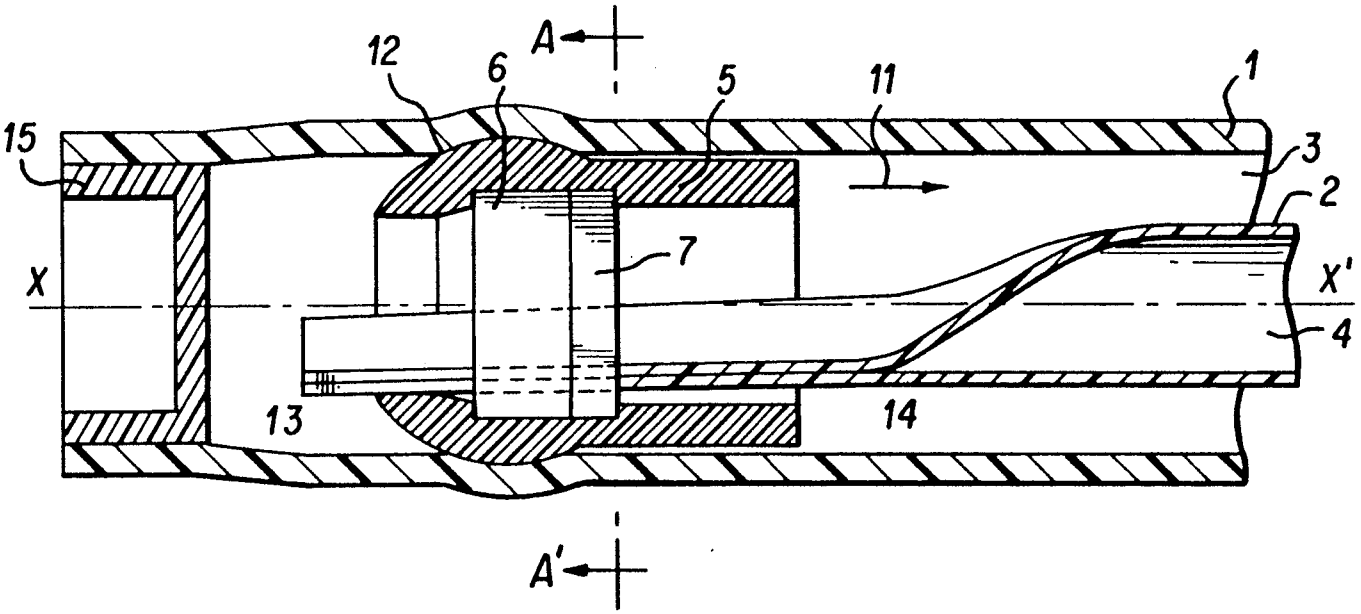
FIG. 2 represents, a longitudinal cross section of one extremity of the device according to the invention.

Cutting edge (7) of the blade faces in the direction of movement. In FIG. 2, it can be seen that tube (4), to the left of cutting edge (7), has already been severed and that to the right of cutting edge (2), remains to be cut.

Cutting edge (7) is approximately in the middle of the sliding element, in the direction of the axis, so that in practice it is virtually impossible to touch this cutting edge with the fingers, even if the device is subsequently dismantled by the user.

FIG. 1 also illustrates a tool whose function is to allow easier movement of the sliding element. The use of this tool is optional. It consists of two parallel rollers (8) and (8') which are mounted on axles (9) and (9') which are interconnected by crossbar (10) which the user holds by hand.

The user merely pushes the tool in the direction shown by arrow (11), or pulls the tube in the opposite direction, thereby causing outer tube (1) to be depressed at points (16), element (5) to be propelled along inner tube (2) and knife (7) to cut tube (2) along its length. The liquids (3) and (4) thus mix and cause the creation of chemiluminescent light along the complete length of the device.

Figure 3:
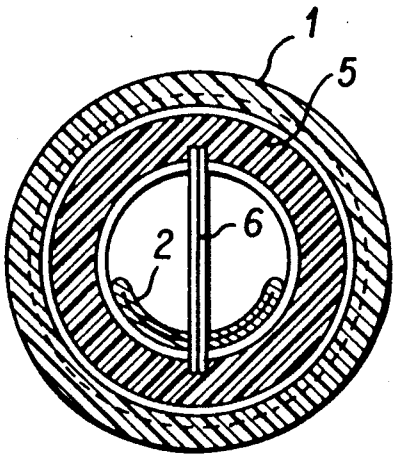
FIG. 3 represents, a transverse cross section along Line AA' of FIG. 2.

FIGS. 2 and 3 represent cross sections of the device according to the invention, before activation and at its extremity, which can be called the initial activation, that is, the activation which begins where the travel path of the sliding element (5) begins. At this place, sliding element (5) is slipped over the beginning section of tube (4) whose walls have been sealed to each other beforehand, e.g. by heating, over the entire area from point (13) to point (14). Blade (6) thus initially passes through part of tube (4) which contains no liquid, so that an accidental leak is prevented. The device can be stored before use with the sliding element in this position.

Stopper (15) closes the end of tube (1), which is sealed to the walls of the latter.

One example of the device according to the invention is described in further detail below.

There is used, an external tube, made of a low-density, translucent, extruded polyethylene, with an inside diameter of 4.3 mm and a wall thickness of 0.4 mm. Its length is 2.20 m. It is closed at its extremities, in a conventional manner, with cuvettes, also made of low-density polyethylene, with a wall thickness of 0.4 mm, and soldered to the walls of the tube by heat, using a heating element, ultrasound, etc.

As an internal tube, there is used one made of translucent polypropylene, which as an inside diameter of 2 mm and a wall thickness of 0.25 mm. It is closed at its extremeities by hot-process crushing which causes the walls to become soldered to each other and flattened.

The two concentrical tubes have substantially the same length, which is a length as desired for the device, e.g. approximately 2.20 m.

The length of a sliding element surrounding the inner tube is approximately 10 mm. It is prepared by injection molding from hard polypropylene, with very smooth interior and exterior walls to facilitate sliding. Its end which faces the direction of movement is shaped as a cylinder with an inside diameter of 2.8 mm and an outside diameter of 4.2 mm and is preferably beveled. The other end is of an approximately spherical configuration and has a diameter of 4.5 mm, and a 2.6 mm central hole.

A blade of hardened steel of the razor blade type, with the dimensions 3.2×2 mm and a thickness of 0.15 mm is positioned in the element. During the injection molding of the sliding element, this blade is placed in the mold so that it is embedded in the molten material which constitutes the sliding element, which provides for a solid and substantially undismantable hold.

The chemical chemiluminescent liquid may also be in the internal tube and the activating solution in the external tube and still fall within the scope of the present invention. Similiarily, but more rarely, one of the two liquids can be replaced by a solid in granular form, etc. Neither of these variations cause a change in the principle of the invention.

Similarly, either of the tubes can be coextruded, with the internal walls thereof consisting of polyethylene and the external walls thereof consisting of a plastic material which is more effective against the permeation of gases. Furthermore, the internal wall of the external tube, and/or the sliding element, can also have a silicon-based surface which can facilitate the movement or displacement of the sliding element.

We claim:

1. A chemiluminescent lighting device comprising two concentric tubes each made of a translucent material and sealed at their ends, one of which contains a first chemical liquid which emits chemiluminescent light upon activation, and the other of which contains a chemical liquid whose function is to cause the activation of the first liquid, the internal tube is being provided with a sliding element which is displaced along the length of said tube by pressure imparted to it through the wall of the external tube, which sliding element is provided with a blade which cuts the internal tube longitudinally as the displacement progresses.

2. A chemiluminescent lighting device according to claim 1, accompanied by a tool which causes the transmission of the pressure via a pair of parallel rollers which are external to the tube, and separated by a distance which is slightly smaller than the outside diameter of the tube, and whose axles are connected by a crossbar.

3. An device according to claim 1 wherein said blade is positioned over a sealed portion of the internal tube prior to displacement.

4. A device according to claim 1 wherein the external tube is flexible.

5. A chemiluminescent element according to claim 1, wherein the wall of either of the tubes consists of a polyolefin resin on the internal side and a plastic material which is more effective against the permeation of gases on the external side.

6. A container comprising two concentric tubes made of a translucent, material each sealed at its ends, one of which contains chemical product A, the other of which contains chemical product B whose function is to cause the activation of a chemical reaction, at least one of product A and product B being in liquid form, the internal tube being provided with a sliding element which is displaced along the length of said tube, by a pressure imparted to it through the wall of the external tube, which sliding element is provided with a blade which cuts the internal tube longitudinally as the displacement progresses.

7. A container according to claim 6, in which the chemical reaction is exothermic.

8. A container according to claim 6, in which the chemical reaction is a hardening reaction of the components.

9. A container according to claim 6 wherein said blade is positioned over a sealed portion of the internal tube prior to displacement.

10. A container according to claim 6 wherein the external tube is flexible.

* * * * *